United States Patent [19]

Anderson, III et al.

[11] 4,414,519

[45] Nov. 8, 1983

[54] TEMPERATURE-SENSITIVE RELAY

[75] Inventors: Philip M. Anderson, III, Chatham; Ronald K. Reich, Phillipsburg, both of N.J.

[73] Assignee: Allied Corporation, Morristown, N.J.

[21] Appl. No.: 356,874

[22] Filed: Mar. 10, 1982

[51] Int. Cl.[3] ..... H01H 51/00

[52] U.S. Cl. ..... 335/208; 335/146

[58] Field of Search ..... 335/208, 146; 337/107

[56] References Cited

U.S. PATENT DOCUMENTS

| | | | |
|---|---|---|---|
| 1,561,386 | 11/1925 | White . | |
| 1,705,716 | 3/1929 | Claytor . | |
| 1,939,076 | 12/1933 | McShane . | |
| 2,182,864 | 12/1939 | Frank . | |
| 2,184,372 | 12/1939 | Von Hoorn . | |
| 2,205,944 | 6/1940 | Dunmire . | |
| 2,781,433 | 2/1957 | Wilckens . | |
| 2,926,227 | 2/1960 | Sundt . | |
| 2,951,927 | 9/1960 | Weller | 219/26 |
| 3,008,019 | 11/1961 | Scheidig | 335/208 |
| 3,188,448 | 6/1965 | Weller | 219/241 |
| 3,226,507 | 12/1965 | Kasahara . | |
| 3,287,541 | 11/1966 | Weller | 219/241 |
| 3,390,360 | 6/1968 | Umeda | 335/146 |
| 3,453,566 | 7/1969 | Kasahara | 335/16 |
| 3,469,217 | 9/1969 | Linton | 335/208 |
| 3,701,063 | 10/1972 | Clausse | 335/146 |
| 3,743,982 | 7/1973 | Kasahara | 335/208 |
| 3,760,310 | 9/1973 | Carson | 335/146 |
| 4,088,976 | 5/1978 | Bell | 337/107 |
| 4,263,573 | 4/1981 | Melton et al. | 337/140 |
| 4,266,211 | 5/1981 | Ulanet | 335/208 |

FOREIGN PATENT DOCUMENTS

| | | | |
|---|---|---|---|
| 545190 | 1/1956 | Belgium | 335/146 |

*Primary Examiner*—Harold Broome

*Attorney, Agent, or Firm*—Paul Yee; Ernest D. Buff; Gerhard H. Fuchs

[57] ABSTRACT

A temperature-sensitive relay is provided with a resilient, movable cantilever composed of amorphous ferromagnetic material having a Curie point. The cantilever is adapted to carry a first contact member. A second contact member is disposed adjacent the first contact member for at least intermittently establishing electrical contact with the first contact member. The relay is adapted to be connected to circuitry having a power source for providing an electrical current and a switching mechanism for activating the circuitry in response to a preselected condition. A magnet is associated with and adapted to bias the cantilever to a first position that interrupts electrical continuity between the first and second contact members. The cantilever is transformed from a ferromagnetic phase to a paramagnetic phase when its temperature exceeds the Curie point, whereby the cantilever assumes a second position in which the electrical continuity is established. A heating means is connected to the circuitry and disposed in the vicinity of the cantilever for heating the cantilever to effect the transformation during a preselected time interval following activation of the circuitry. The relay is lightweight, compact, economical to manufacture and reliable in operation.

12 Claims, 8 Drawing Figures

TEMPERATURE-SENSITIVE RELAY

DESCRIPTION

This application relates to the field of temperature-sensing electrical relays, and more particularly to a thermal relay utilizing the Curie temperature of an amorphous ferromagnetic material to operate the relay.

BACKGROUND OF THE INVENTION

Thermal relays conventionally used to control circuits typically include a laminated bimetallic element, the two materials of which have different thermal coefficients of expansion, so that the bimetallic element moves from one position to another in response to an increase or decrease in ambient temperature. A contact carried by the bimetallic element is thereby moved towards or away from a fixed contact in response to ambient temperature changes to make or break a circuit. The movement is gradual, causing engagement and disengagement between the contacts to be effected too slowly. Contact wear is accelerated and the switch fails prematurely.

To increase the velocity of the movable contact, bimetallic elements have been formed with cutout sections or with curved cross sections that provide a "snap" action. Such modifications increase the cost of the relay and subject the element to Joule heating, which can adversely alter the characteristics of the bimetal, and hence the accuracy and reliability of the relay. Relay constructions wherein relative movement between the contacts is due in part to temperature characteristics of a magnetic material, such as those taught by U.S. Pat. Nos. 2,951,927 and 3,287,541, provide contact velocities too slow to prevent contact wear and premature switch failure. For these reasons, temperature-sensitive relays of the type described have resulted in higher purchase and maintenance costs than are considered to be commercially acceptable.

SUMMARY OF THE INVENTION

The present invention provides a temperature-sensitive relay that is light-weight, compact, economical to manufacture and highly reliable in operation. Generally stated, the relay is adapted to be connected to circuit means having a power source for providing an electrical current and switching means for activating said circuit means in response to a preselected condition. The relay is mounted on base means that support a resilient movable cantilever carrying a first contact member. The cantilever is a composite member having a first portion composed of conductive material and a second portion composed of amorphous ferromagnetic material having a Curie point. A second contact member is disposed adjacent the first contact member for at least intermittently estabilishing electrical contact with said first contact member. The first and second contact members are connected to first and second terminal means, respectively. Gripping means support the cantilever and electrically connect it to the first terminal means. Support means are provided for supporting the second terminal means. A magnet means is associated with and adapted to bias the cantilever to a first position that interrupts electrical continuity between the first and second contact members. The cantilever is transformed from a ferromagnetic phase to a paramagnetic phase when its temperature exceeds the Curie point, whereby said cantilever assumes a second position in which said electrical continuity is established. A heating means is connected to the circuit means and disposed in the vicinity of the cantilever for heating said cantilever to effect said transformation during a preselected time interval following activation of the circuit means.

BRIEF DESCRIPTION OF THE DRAWINGS

The invention will be more fully understood and further advantages will become apparent when reference is made to the following detailed description of the preferred embodiments of the invention and the accompanying drawings in which.

DETAILED DESCRIPTION OF THE INVENTION

Figure 1:
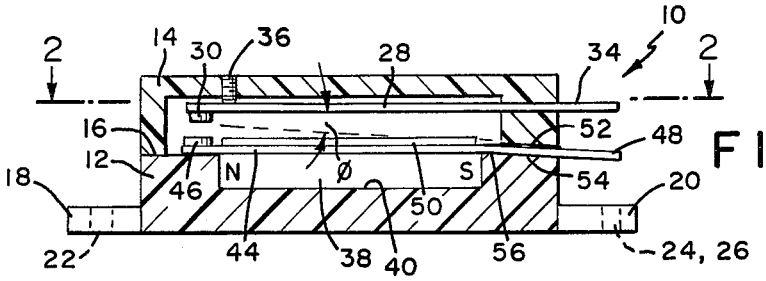
FIG. 1 is a side elevational view, partially in section, of a first embodiment of the invention.
Figure 2:
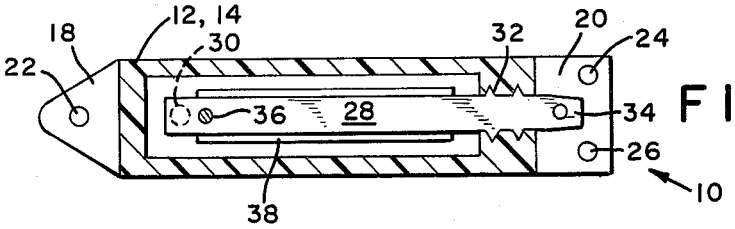
FIG. 2 is a top elevational view, taken along the line 2—2 of FIG. 1.

Referring to FIGS. 1 and 2 of the drawings, there is shown a first embodiment of a temperature-sensitive relay according to the invention. The relay 10 has a base member 12 and a cap member 14, preferably made of non corrosive metal such as brass, stainless steel or the like, or of plastic and assembled by the use of adhesive or welding along joint 16. Relay 10 may be provided with separate mounting provisions shown as mounting provisions 18 and 20, provided with mounting holes 22, 24 and 26. Alternately, mounting provisions 18 and 20 may be omitted, and relay 10 may be adhesively attached to the item whose temperature is to be sensed. Further, the relay 10 may be housed with a metal, threaded cylinder and mounted within the engine block with an end of the cylinder in communication with the engine coolent fluid.

In FIG. 1, a longitudinally-extending contact member 28 having a contact 30 is retained in cap member 14, preferably being molded into cap member 14 and having projections 32 to enhance its retention in cap member 14. As illustrated, terminal means 34 of contact member 28 is formed into the shape of a conventional spade lug, for ease in making electrical connection to members such as contact member 28. Cap member 14 may also be provided with stop or adjustment means 36, for adjusting the position of contact member 28. As shown, stop or adjustment means 36 is a threaded member, and made adjustable for adjusting the position of contact 30. However, it should be noted that the provision of stop or adjustment means 36 is not strictly necessary to practice the invention.

A magnet 38 is disposed in a cavity 40 in base member 12, adjacent a movable contact member 44 having a contact 46, and having a first terminal means 48 extending to the exterior of thermal switch 10, and preferably formed into the shape of a conventional spade lug, to facilitate electrical connection. As shown, one or more pieces of amorphous metal 50 are attached such as by laminating or bonding, to movable contact member 44, which is disposed adjacent magnet 38. As will be apparent, amorphous metal 50, below its Curie temperature, will act as a magnetic shunt for magnet 38, and will thus be attracted to magnet 38, to retain movable contact member 44 in the position illustrated.

FIG. 1 also illustrates a simple structure for urging movable contact member 44 towards stationary contact member 28, hereinafter referred to as second contact member 28. As shown in FIG. 1, a resilient, movable cantilever 44 is retained in thermal switch 10 by entrapping surfaces 52 and 54, which may advantageously be provided with recesses to receive projections similar to projections 32 of member 28, which may also be provided on cantilever 44. As shown, surfaces 52 and 54 are parallel to each other and lie in a plane which makes an acute angle such as angle with second contact member 28. Movable cantilever 44 is released from magnet 38 when amorphous metal 50 reaches its Curie temperature, whereupon it will straighten at bent area 56 and cause contact 46 to move against contact 30, establishing electrical connection between first terminal means 48 and a second terminal means 34.

Figure 3:
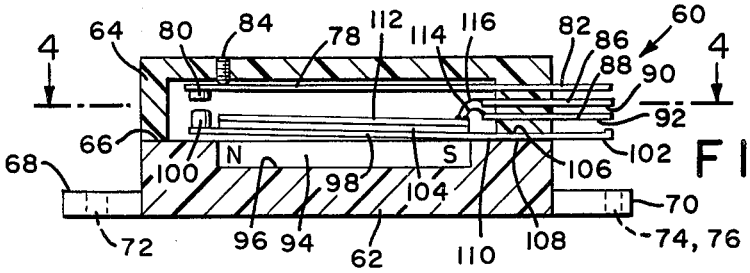
FIG. 3 is a side elevational view, partially in section, showing a second embodiment of the invention.
Figure 4:
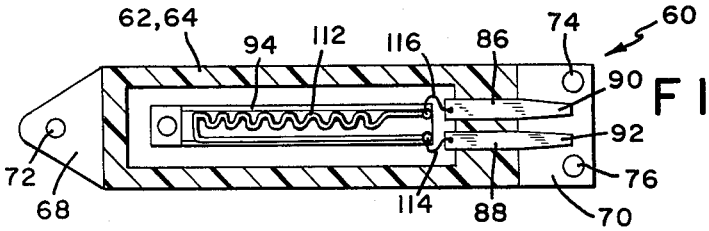
FIG. 4 is a top elevational view of the thermal relay of FIG. 3, taken along the line 4—4 of FIG. 3.

FIGS. 3 and 4 illustrate a second embodiment of the invention, including heater means, and also show an alternate method of biasing the contacts together. There, a temperature-sensitive relay 60 is provided with a base member 62 and a cap member 64, which may be adhesively assembled at joint 66. Of course, numerous conventional methods of assembling such a thermal switch are also possible. Base member 62 may be provided with mounting provisions 68 and 70, if desired, or may be adhesively attached to the desired mounting surface. If provided, mounting provisions 68 may have a mounting hole 72, and mounting provisions 70 may have mounting holes 74 and 76.

A second contact member 78 carrying a contact 80 extends into relay 60, and may be provided with projections, such as projections 32, shown in FIG. 2, to aid in its retention in cap member 64. Cap 64 is preferably molded around member 78. Second contact member 78 may be provided with an end 82 formed in the shape of a spade lug, to facilitate electrical connection. As shown, cap member 64 is provided with a stop or adjustment means 84 for adjusting the position of contact 80. As above, means 84 is not strictly necessary to practice the invention but may be desirable to provide contact clearance for manufacturing variations. Cap member 64 also includes terminal 86 and 88, being inserted through cap member 64 at the time cap member 64 is formed, and which may be provided with projections such as projections 32 shown in FIG. 2 to aid in their retention. Terminal members 86 and 88 may have ends 90 and 92, respectively, formed in the shape of a spade lug or other convenient configuration to facilitate connection to an external circuit.

Base member 62 is provided with a magnet 94 disposed in a cavity 96 in base member 64. A movable cantilever 98 carrying a contact 100 and having an end 102 extending to the exterior of relay 60 preferably formed in the shape of a spade lug, or other convenient configuration, to facilitate its connection to an external circuit. As shown, cantilever 98 is disposed adjacent magnet 94. As before, cantilever 98 is fabricated of a material chosen for its electrical conductivity, and preferably of a non-ferromagnetic material, so that the attraction of cantilever 98 towards magnet 94 may be determined by a strip of amorphous metal 104 having a known Curie temperature, which is attached to cantilever 98, such as by lamination or bonding and which comprises a second portion of cantilever 98. Cantilever 98 is retained in relay 60 by means of entrapping surfaces 106 and 108, on cap members 64 and base members 62, respectively, which entrap a portion of cantilever 98. Cantilever 98 may be provided with projections such as projections 32, shown in FIG. 2, which mate with corresponding provisions of entrapping surfaces 106 and 108.

The cantilever 98 is resiliently biased towards second contact member 78, and away from magnet 94, by the provision of a bent area 110 in cantilever 98. Thus, the unrestrained position of cantilever 98 would form an obtuse angle about bent portion 110, which, in assembled position, would place contact 100 in firm contact with contact 80. Cantilever 98 is maintained in a straightened position by the attraction between magnet 94 and amorphous metal 104 when amorphous metal 104 is below its Curie point temperature, and released to move towards its free position when the Curie temperature is exceeded.

The cantilever 98 is also provided with a separate heater, to allow it to respond to an external electrical command, as well as to ambient temperature. As shown, a heater means such as resistance heater means 112 is placed adjacent to the strip 104 of amorphous material, which strip 104 is secured to and integral with cantilever 98. Such resistance heaters are known for use with bimetallic temperature switch elements, and may include an insulated resistive conductor wound around the moving element, or a wound, film or composition resistor placed adjacent the moving element. In the illustrated embodiment, resistance heater means 112 is a printed circuit resistance heater having a serpentine configuration, which is bonded to amorphous metal 104, and electrically connected to terminal members 86 and 88 by wires 114 and 116. Thus, amorphous metal 104 may be heated to its Curie point temperature either by ambient temperature or by current passed through resistance heater means 112, by way of terminal members 86 and 88.

The amorphous ferromagnetic material, of which the second portion of the cantilever is composed, is prepared by cooling a melt of the desired composition at a rate of at least about $10^{5}$° C./sec, employing metal alloy quenching techniques well-known to the glassy metal alloy art; see, e.g., U.S. Pat. No. 3,856,513 to Chen et al. The purity of all compositions is that found in normal commercial practice.

A variety of techniques are available for fabricating continuous ribbon, wire, sheet, etc. Typically, a particular composition is selected, powders or granules of the requisite elements in the desired portions are melted and homogenized, and the molten alloy is rapidly quenched on a chill surface, such as a rapidly rotating metal cylinder.

Under these quenching conditions, a metastable, homogeneous, ductile material is obtained. The metastable material may be glassy, in which case there is no long-range order. X-ray diffraction patterns of glassy metal alloys show only a diffuse halo, similar to that observed for inorganic oxide glasses. Such glassy alloys must be at least 50% glassy to be sufficiently ductile to permit subsequent handling, such as stamping the cantilever from ribbons of the alloys without degradation of the cantilever's ferromagnetic properties. Preferably, the glassy metal cantilever must be at least 80% glassy to attain superior ductility.

By homogeneous is meant that the material, as produced, is of substantially uniform compositions in all dimensions. By ductile is meant that the cantilever material can be bent to a round radius as small as ten times the foil thickness without fracture.

The metastable phase may also be a solid solution of the constituent elements. In the case of the cantilever of which temperature-sensitive switch 10 is comprised, such metastable, solid solution phases are not ordinarily produced under conventional processing techniques employed in the art of fabricating crystalline alloys. X-ray diffraction patterns of the solid solution alloys show the sharp diffraction peaks characteristic of crystalline alloys, with some broadening of the peaks due to desired fine-grained size of crystallites. Such metastable materials are also ductile when produced under the conditions described above.

Preferably the material of which the second portion of the cantilever is composed, consists essentially of a composition defined by the formula $M_xM_a'Z_y$, where M is one or more metals selected from the group consisting of Fe and Co; M' is one or more alloying metals selected from the group consisting of Ni, Ti, V, Cr, Mn, Zr, Nb, Mo, Hf, Ta, W, Zn, Al and Cu; Z is one or more metalloid elements selected from the group consisting of B, Si, C and P; x, a and y are in atomic percent and range from about 70–85, 0–12 and 15–30, and the sum x+a+y equals 100.

Amorphous alloys especially suited for use as the cantilever material are defined by the formula $Fe_xNi_{73-x}Mo_4B_{11}Si_{12}$, where subscripts are in atom percent and x ranges from 16 to 100.

It has been found that the Curie temperature of such a composition changes approximately 10° C. (18° F.) for each one percent change in the amount of iron therein. For instance the composition $Fe_{16}Ni_{57}Mo_4B_{11}Si_{12}$ has Curie temperature −96° C. (−141° F.), $Fe_{27}Ni_{46}Mo_4B_{11}Si_{12}$ has a Curie temperature of 32° C. (87° F.), $Fe_{33}Ni_{40}Mo_4B_{11}Si_{12}$ has a Curie temperature of 96° C. (260° F.) and $Fe_{36}Ni_{37}Mo_4B_{11}Si_{12}$ has a Curie temperature of 138° C. (280° F.). The Curie temperatures of five suitable three-component alloys having approximately 80 percent of iron and molybdenum and approximately 20 percent of boron are set forth below.

| Alloy | Curie Temperature (°C.) |
|---|---|
| $Fe_{74}Mo_7B_{19}$ | 145 |
| $Fe_{72.5}Mo_{7.5}B_{20}$ | 150 |
| $Fe_{75}Mo_{5.5}B_{19.5}$ | 180 |
| $Fe_{76}Mo_4B_{20}$ | 195 |
| $Fe_{78}Mo_{3.5}B_{18.5}$ | 235 |

Amorphous alloys especially suited for use as the second portion of the cantilever are defined by the formula $Fe_xNi_{73-x}Mo_4B_{11}Si_{12}$, where subscripts are in atom percent and x ranges from 16 to 100.

Figure 5:
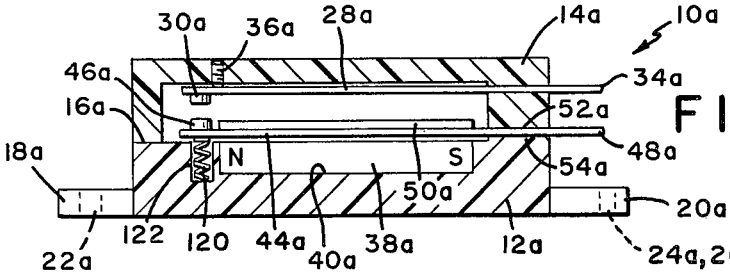
FIG. 5 shows a side elevational view, partially in section, of a thermal relay having a separate resilient means for biasing the cantilever towards a closed or open position.

FIG. 5 shows a thermal switch 10a according to the invention, which is similar to thermal switch 10, having a base member 12a and a cap member 14a, preferably adhesively assembled at a joint 16a and optional provided with mounting provisions 18 and 20 with mounting holes 22, 24 and 26. A second contact 28a having an end 34a and carrying a contact 30a is provided extending through cap member 14a, which is provided with a stop or adjustment means 36a for adjusting the position of contact 30a. Base member 12a is provided with a magnet 38a disposed in a cavity 40a in base member 12a. As before, a movable cantilever 44, carrying a contact 46a and having an end 48a formed in a suitable configuration to facilitate electrical connection, and provided with a piece of amorphous metal 50a, is positioned adjacent magnet 38a so that amorphous metal 50a forms a shunt or path for the flux of magnet 38a, and is attracted thereto. Entrapping surfaces 52a and 54a retain cantilever 44 in relay 10a with end 48a extending to the exterior of relay 10a. However, unlike the embodiment shown in FIG. 1, entrapping surfaces 52a and 54a do not hold cantilever 44a in a stressed position. Rather, bias force, urging contact 46a against contact 30a, which is opposed by the attractive forces between amorphous metal 50a and magnet 38a, is provided by a spring 120, shown as a compression spring, disposed in a cavity 122 formed in base member 12a. As will be apparent, a tension spring could also be used for resiliently biasing contacts 30a, if desired.

Figure 6:
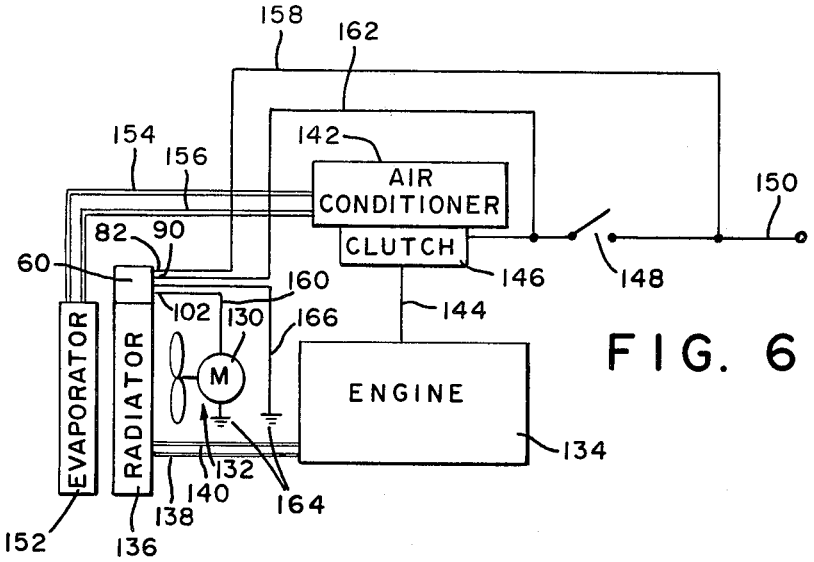
FIG. 6 is a schematic drawing showing the embodiment of FIG. 2 as used to control a radiator cooling and condenser fan.

FIG. 6 shows a temperature-sensitive relay 60 used to control the electrical motor 130 of cooling fan assembly 132. As shown in FIG. 6, an engine 134 such as a vehicle engine is provided with a cooling radiator 136, connected to engine 134 by coolant lines 138 and 140. Engine 134 operates an air conditioner 142, and is connected to air conditioner 142 by drive means 144 through clutch means 146. An air-conditioning switch 148 supplies electrical power from connection means 150, connected to a source of electrical power, to clutch means 146 to operate air conditioner 142. Air conditioner 142 includes a condenser 152, connected to it by lines 154 and 156, in a conventional manner. As will be apparent from FIG. 6, it is desirable to provide a flow of air through radiator 136 when cooling of engine 134 is necessary, and also to provide a flow of cooling air through condenser 152, mounted adjacent radiator 136, when air conditioner 142 is operated.

As shown in FIG. 6, power is supplied to end 82 of stationary contact member 78 of relay 60 from connection means 150 through wire 158. Temperature-sensitive relay 60 is mounted adjacent radiator 136 either by the use of mounting holes 72, 74 and 76, or by adhesively bonding it to radiator 136. Alternatively, relay 60 is mounted to the block of the engine in a coolant passage wall such that the case of the relay touches the coolant fluid. Thus, when cooling fluid 136 reaches a predetermined temperature, amorphous metal 104 will reach its Curie temperature, so that it will no longer be attracted to magnet 94, and contacts 80 and 100 will close, establishing a circuit between ends 82 and 102. End 102 of cantilever 98 is connected to motor 130 through wire 160 to operate fan assembly 132 when relay 60 is actuated responsive to radiator 136. If switch 148 is operated to engage clutch 146, power will be applied to end 90 of terminal member 86 through wire 162. End 92 of terminal member 88 is connected to ground 164 by wire 166, current then flowing through heater means 112 in response to air-conditioning switch 148, and causing relay 60 to be operated to operate fan assembly 132 to force air through condenser 152.

Operation of switch 148 may be affected automatically by coupling the switch means 148 to a second relay (not shown) movable from an open to a closed position when temperature within the vehicle passenger compartment exceeds a predicted boil. Alternatively, switch 148 may be operated manually, by an accessory lever or the like disposed on the dashboard or other convenient location within the passenger compartment.

Figure 7:
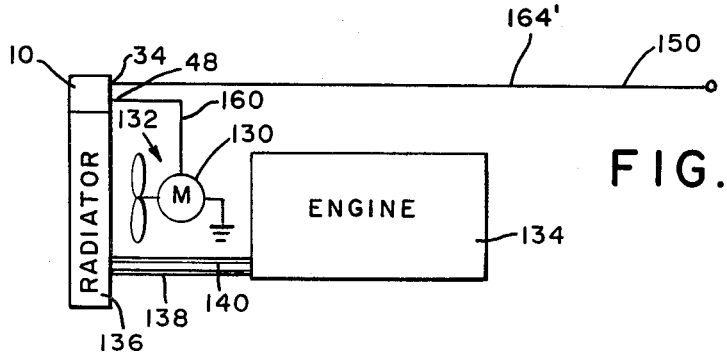
FIG. 7 is a schematic diagram showing the embodiment of FIG. 1 as used to control a radiator cooling fan.

FIG. 7 illustrates the use of a temperature-sensitive relay 10 in conjunction with the radiator 136 of an engine 134 not provided with an air-conditioning unit to operate an electrical motor 130 of a cooling fan assembly 132. As shown, relay 10 is mounted adjacent radiator 136, such as by the use of mounting holes 22, 24 and 26, or by adhesively attaching relay 10 to radiator 136. Alternatively, relay 60 is mounted on the engine block in the coolant passage wall so that the relay case contacts the coolant. As shown, end 34 of stationary contact 28 is connected to connection means 150 by a wire 164', and end 48 of cantilever 44 is connected to motor 130 by a wire 160. Thus, when coolant fluid 136 reaches a predetermined temperature, amorphous metal 50 will reach its Curie point temperature, causing it to cease to be attracted to magnet 38, and allowing contacts 46 and 30 to close, connecting wires 164' and 160, and energizing motor 130.

Figure 8:
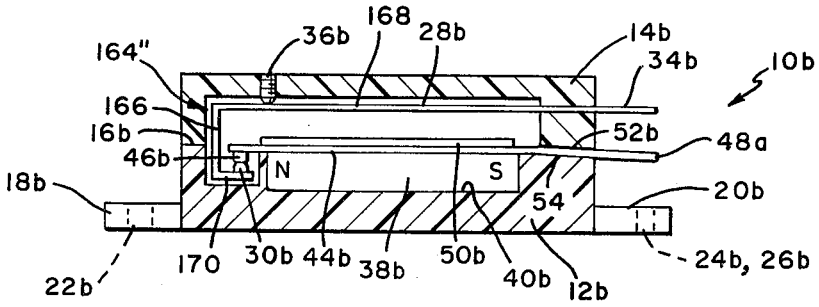
FIG. 8 is a side electrical view showing the embodiment of FIG. 1 as used to open a circuit upon application thereto of heat above a predicted temperature.

FIG. 8 is an illustration showing the invention applied to a device which opens a circuit upon heating. The embodiment of the invention shown in FIG. 8 is similar to that of FIG. 1 except in the positioning of the contacts. As shown, second contact member **28*b*, at an end distal to end 34*b*, has an L-shaped extension 164'' having a first portion 166 perpendicular to body 168 of member 28*b*, and a second member 170 which is shown as perpendicular to first member 166 and parallel to body 168, with contact 30*b* mounted on second member 170 and disposed in contact with contact 46*b* when cantilever 44*b* is attracted to magnet 38*b* due to amorphous metal 50*b* being below its Curie point temperature. This modification requires only that stationary contact 28*b* be provided with extension 166, and that contact 46*b* of cantilever 44*b* be moved to an opposite side of member 44*b*. As will be apparent, this modification may also be easily and simply implemented in the embodiment shown in FIGS. 3, 4 and 5**.

In the illustrated embodiments of the invention, base members 12 and 62 and cap members 14 and 64 may be made from a plastic material and fastened together by adhesives or by sonic welding or the like. Cantilever 44 and the second contact member may be fabricated of any convenient conductive material. However, if they are made of a magnetic material, bias means such as described above must exert a force greater than the normal attraction of a cantilever 44, **44*a* or 98 to a magnet such as 38, 38*a* or 94, so that the operation of the relay will be controlled by the variation in magnetic attraction caused by temperature passing through the Curie point temperature of an amorphous metal such as 50, 50*a* or 104**.

Thus, the instant invention provides a simple construction for a temperature-sensitive relay, utilizing the desirable magnetic characteristics and sharp Curie point temperature magnetic transition of an amorphous metal to provide dependable operation and long life with unchanged characteristics, and which may be actuated only by ambient temperature or by ambient temperature and an external electrical signal.

Having thus described the invention in rather full detail, it will be understood that such detail need not be strictly adhered to but that various changes and modifications may suggest themselves to one skilled in the art, all falling within the scope of the invention as defined by the subjoined claims.

We claim:

1. A temperature-sensitive relay adapted to be connected to circuit means having a power source for providing an electrical current and switching means for activating said circuit means in response to a preselected condition, said realy comprising:

base means for mounting said temperature-sensitive relay;

a resilient movable cantilever carrying a first contact member, said cantilever being a composite member having a first portion composed of conductive material and a second portion composed of amorphous ferromagnetic material having a Curie point;

a second contact member disposed adjacent said first contact member for at least intermittently establishing electrical contact with said first contact member;

said first contact member being connected to first terminal means;

said second contact member being connected to second terminal means;

gripping means for supporting the cantilever and electrically connecting it to said first terminal means;

support means for supporting said second terminal means;

magnet means associated with and adapted to bias said cantilever to a first position that interrupts electrical continuity between said first and second contact members, said cantilever being transformed from a ferromagnetic phase to a paramagnetic phase when its temperature exceeds the Curie point, whereby said cantilever assumes a second position in which said electrical continuity is established;

heating means connected to said circuit means and disposed in the vicinity of said cantilever to effect said transformation during a preselected time interval following activation of said circuit means; and bias means for urging said cantilever to move said first contact member to said second position.

2. A relay as recited in claim 1, wherein:

said bias means includes a first portion of said cap member and a second portion of said base member, said first portion and said second portion entrapping a portion of said cantilever, and said first portion and said second portion being parallel to each other and disposed at an acute angle relative to said stationary contact member, thereby holding said entrapped cantilever portion at said acute angle to urge said resilient cantilever and said first contact toward said second position.

3. A relay as recited in claim 1, wherein:

said bias means is a bent portion of said cantilever.

4. A relay as recited in claim 1, wherein:

said bias means is a resilient means interposed between said base member and said cantilever.

5. A relay as recited in claim 1, wherein:

said amorphous ferromagnetic material has a composition consisting essentially of $Fe_{33}Ni_{40}Mo_4B_{11}Si_{12}$, subscripts being in atom percent.

6. A relay as recited in claim 1, wherein:

said heating means is disposed in said base means.

7. A relay as recited in claim 1, wherein:

said amorphous ferromagnetic material consists essentially of a composition defined by the formula $M_aM'_aZ_y$, where M is at least one metal selected from the group consisting of Fe and Co; M' is at least one metal selected from the group consisting of Ni, Ti, V, Cr, Mn, Zr, Nb, Mo, Hf, Ta, W, Zn, Al and Cu, Z is at least one metalloid element selected from the group consisting of B, Si, C and P, x, a and y are in atomic percent and range from about 70–85, 0–12 and 15–30, respectively, and the sum of x+a+y equals 100.

8. A relay as recited in claim 1, further comprising means for connecting said relay to said circuit means to operate the electrical motor of a cooling fan for a vehicle radiator.

9. A relay as recited in claim 8, further comprises switch means disposed within the passenger compartment of said vehicle, said switch means being movable between an open position that interrupts electrical continuity between said power source and said heating means and a closed position that establishes electrical continuity between said power source and said heating means.

10. A relay as recited in claim 9, wherein said switch means comprises means for manual movement between said open and closed positions.

11. A realy as recited in claim 9, wherein said switch means, a comprises a second relay coupled thereto and movable from said open position to said closed position when temperature within said passenger compartment exceeds a preselected level.

12. A relay as recited in claim 1, wherein said magnet means is adpated to bias said cantilever to a first position that establishes electrical continuity between said first and second contact members, and wherein said cantilever is transformed from said ferromagnetic phase to said paramagnetic phase when its temperature exceeds the Curie point, whereby said cantilever assumes a second position in which said electrical continuity is interrupted.

* * * * *